US011419368B2

(12) United States Patent
Schnadt et al.

(10) Patent No.: US 11,419,368 B2
(45) Date of Patent: Aug. 23, 2022

(54) NURSING BRA

(71) Applicant: MEDELA HOLDING AG, Baar (CH)

(72) Inventors: Annina H. Schnadt, Zug (CH); Andrea Zimmermann, Oberrüti (CH)

(73) Assignee: MEDELA HOLDING AG, Baar (CH)

( * ) Notice: Subject to any disclaimer, the term of this patent is extended or adjusted under 35 U.S.C. 154(b) by 96 days.

(21) Appl. No.: 16/759,279

(22) PCT Filed: Nov. 2, 2018

(86) PCT No.: PCT/EP2018/079979
§ 371 (c)(1),
(2) Date: Apr. 24, 2020

(87) PCT Pub. No.: WO2019/086591
PCT Pub. Date: May 9, 2019

(65) Prior Publication Data

US 2020/0253292 A1 Aug. 13, 2020

(30) Foreign Application Priority Data

Nov. 2, 2017 (EP) ..... 17199749

(51) Int. Cl.
*A41C 3/04* (2006.01)
*A41C 3/00* (2006.01)
*A41F 15/00* (2006.01)

(52) U.S. Cl.
CPC ..... *A41C 3/04* (2013.01); *A41C 3/0071* (2013.01); *A41F 15/002* (2013.01)

(58) Field of Classification Search
CPC ..... A41C 3/0071; A41C 3/004; A41D 15/002
(Continued)

(56) References Cited

U.S. PATENT DOCUMENTS 4,633,876 A * 1/1987 Scullin ..... A41C 3/04 450/36
6,227,936 B1 5/2001 Mendoza
(Continued)

FOREIGN PATENT DOCUMENTS

CN 205962878 U 2/2017
WO WO-2012092655 A1 7/2012

OTHER PUBLICATIONS

Chinese First Office Action with English Translation for Application No. 201880078185.4, dated Jul. 28, 2021.
(Continued)

*Primary Examiner* — Gloria M Hale
(74) *Attorney, Agent, or Firm* — Marshall, Gerstein & Borun LLP

(57) ABSTRACT

Nursing bra with a back part and a breast part, which form a circumferential envelopment for the upper body in the connected state, with shoulder straps extending between the breast part and the back part and with two bra cups, each formed adapted to accommodate a female breast and each releasably connected to the shoulder straps and each having an opening that leads to the nipple of the female breast and that is on the outer side covered by an outer ply which is removable from the opening. A nursing bra of the type mentioned above that provides high functionality while having an attractive appearance is created according to the invention in that a flap is provided on the inner side of the bra cup and covers the opening.

10 Claims, 4 Drawing Sheets

(58) Field of Classification Search
USPC ..... 450/36
See application file for complete search history.

(56) References Cited

U.S. PATENT DOCUMENTS

| | | | | |
|---|---|---|---|---|
| 2007/0161330 | A1 | 7/2007 | Whitehead et al. | |
| 2009/0265830 | A1* | 10/2009 | Hendrickson | A41D 1/215 2/104 |
| 2009/0265831 | A1* | 10/2009 | Hendrickson | A41D 1/215 2/104 |
| 2011/0314587 | A1* | 12/2011 | Ritchie | A41C 3/04 2/104 |
| 2013/0232661 | A1* | 9/2013 | Huntley | A41C 3/08 2/104 |
| 2016/0150834 | A1* | 6/2016 | Boele | A41C 3/0035 450/36 |
| 2017/0303606 | A1* | 10/2017 | Curry | A41F 15/002 |
| 2019/0000152 | A1* | 1/2019 | Fletcher | A41C 3/12 |

OTHER PUBLICATIONS

International Search Report for Application No. PCT/EP2018/079979, dated Dec. 7, 2018.
European Search Report for Application No. 17199749.7, dated Apr. 13, 2018.

* cited by examiner

NURSING BRA

CROSS-REFERENCE TO RELATED APPLICATION

The present application is the US national phase of International Patent Application No. PCT/EP2018/079979, filed Nov. 2, 2018, which claims priority to European Patent Application No. 17199749.7, filed Nov. 2, 2017. The priority applications are hereby incorporated by reference in their entirety.

FIELD OF THE DISCLOSURE

The present invention relates to a nursing bra with a back part and a breast part which in the connected state form a circumferential envelopment for the upper body of a woman.

BACKGROUND AND SUMMARY

The circumferential envelopment is preferably releasable at one location and has a catch for this purpose. This catch in the nursing bra of the invention can be disposed between different regions of the back part or the breast part or between the back part and the breast part. This configuration makes it possible to first wrap the nursing bra around the breast and to then close it in order to don the nursing bra around the body, possibly with a certain amount of pre-tension. If the circumferential envelopment is formed from elastic material, the catch can also be omitted. Such a design, which is donned in the stretched state, can also be according to the invention. The nursing bra according to the invention further comprises shoulder straps extending between the front part and the back part. These shoulder straps are preferably adjustable in a manner known per se also in the nursing bra according to the invention. Accordingly, the shoulder straps are variable in length. The nursing bra according to the invention also comprises two bra cups which are each formed adapted to accommodate a female breast. The nursing bra according to the invention also serves to support the female breast. The latter is accommodated in the bra cups and supported by the circumferential envelopment and the shoulder straps. The nursing bra according to the invention is not restricted to a particular size and can be adapted to the respective individual circumstances of the female breast by appropriate tailoring.

The features discussed above are typical for bras. The bra according to the invention additionally has the option to release each of the bra cups from the shoulder straps to which the bra cups are typically connected. The bra cups of the nursing bra according to the invention can be formed from typical bra materials. They are preferably made of material that surrounds the breast in a soft and comfortable manner. In particular when breastfeeding, the female breast is sometimes sensitive, so that a support as smooth as possible and pleasant to the skin and the nipples is desired. However, the nursing bra according to the invention also comprises an opening leading to the nipple of the female breast. This opening is formed in each of the two bra cups. This provides the option that a breast shield, which surrounds the nipple and is suitable for expressing breast milk with a respective pump, is passed through the bra cup.

Such a nursing bra is known, for example, from U.S. Pat. No. 6,227,936 B1. In this prior art, the bra cups are provided with a punched-out opening through each of which a breast shield can be passed, so that the bra supports and holds the breast and the breast shield during the expression action.

A similar nursing bra is known from US 2007/0161330 A1 and from US 2011/0314587 A1, respectively. In the prior art last mentioned, which is considered to be generic, the bra cups are formed by two cuttings which are not completely connected to each other at their joining point, thereby forming the opening leading to the nipple. The prior art nursing bra, however, is cut such that the nipple is disposed within the opening, for which reason a second outer layer is required to cover and protect the nipple.

The solution previously known from US 2011/0314587 is designed such that breast milk can be expressed through the opening even when the bra cup is donned. Moreover, the respective bra cup is releasably connected to the associated shoulder strap to release at least one bra cup from the support device to expose a breast for breastfeeding.

The present invention seeks to provide a nursing bra that provides high functionality while having an attractive appearance.

For satisfying this object, a nursing bra having the features of claim 1 is provided with the present invention. It differs from the known nursing bra previously described in that a flap is provided on the inner side of the bra cup and covers the opening. The flap covers at least the opening on the inner side. The flap is typically configured such that the nipple, when accommodated in the bra cup, is surrounded by soft and seamless material which is typically provided between the nipple and the opening, but can be moved from this initial position to a use position in which the nipple is accessible through the opening. The flap can be fixedly or releasably connected to the cup element. For example, the flap can be connected to the cup element by way of a hook-and-loop fastener. The cup element can be formed integrally or from several parts. In an integrally formed configuration, the cup element is preferably molded for shaping. The cup element is typically made of padded soft material. The flap as well is preferably made of such padded material. The flap can, in particular, be sewn to the material of the bra cup. In the case of a multi-part bra cup, the flap can then be cut out in one piece from a cutting forming a partial region of the bra cup, so that it reaches over another cutting co-forming the bra cup in order to cover the opening.

The nursing bra according to the invention can also be designed as a body suit, a nightgown, a bikini, a swimsuit.

According to one preferred embodiment of the present invention, the outer ply is formed by a decorative ply. The decorative ply can itself be cut in the manner of a bra. In any case, the decorative ply can also be realized as an integrally molded cutting associated with the respective bra cup. However, the decorative ply usually has only a decorative function and no support function. However, the decorative ply can also be designed such that only parts of the bra cup and/or the circumferential envelopment and/or the shoulder straps are covered by the decorative ply. The decorative ply can also be inventive in itself, i.e. further develop a nursing bra with a back part and a breast part, which form a circumferential enclosure for the upper body in the connected state, with shoulder straps extending between the breast part and the back part and with two bra cups, each formed adapted to accommodate a female breast and each releasably connected to the shoulder straps and each having an opening that leads to the nipple of said female breast and that is on the outer side covered by an outer ply which is removable from the opening.

The nursing bra according to the invention can be formed by the decorative ply like a conventional bra with an attractive appearance. The decorative ply can have, for example, an at least partially decorative and/or open-worked layer consisting of yarn or yarn and textile material or be entirely formed thereon. In particular, the decorative ply can be formed from lace.

With this appealing appearance, however, the nursing bra according to the invention does not lose its functionality. The decorative ply can merely hang loosely over the bra cups, so that, for expressing breast milk, the opening formed in the bra cup can be exposed to pass a breast shield with its tubular opening through the opening of the bra cup and express milk.

With regard to an appearance of the nursing bra according to the invention corresponding to a conventional bra enclosing the breast in a manner following the contour, it is proposed according to a preferred embodiment of the present invention to connect the outer ply, preferably the decorative ply, to the shoulder straps in a releasable manner. The decorative ply then looks like the typical, possibly only layer of a normal bra. The decorative ply is usually cut in a shaping manner, so that it encloses and supports the contour of the female breast in a manner following the contour. The same applies to the bra cups, so that the decorative ply attached to the shoulder straps creates the impression of a bra enclosing the breast in a manner following the contour. The decorative ply there forms an outer decorative layer which typically covers the bra cups over their entire surface and follows their shape. Accordingly, the decorative ply is preferably tailored like the bra cups. It is understood that the material forming the decorative ply can be provided as an outer layer of the circumferential envelopment or as the sole textile material for forming the back part and the breast part, in order to create the most uniform possible appearance. The external appearance of the nursing bra according to the invention can then be of a uniform material design and/or color and/or have a textural uniform design. A textural uniform design is understood, in particular, to be a texture provided uniformly on the outer side of the nursing bra. This texture can be, for example, lace. It can also be decoratively woven fabric and/or fabric provided with a pattern. The base material of the nursing bra according to the invention can be cotton or synthetic fiber or even a combination of both. The bra cup is typically formed in several plies and has, for example, a reinforcement ply, especially made of foam or other textile material with greater stiffness and thickness, which also has a certain cushioning effect. Also conceivable for the production of nursing bras according to the invention are elastic or non-elastic woven, knitted, decorated or printed materials, where decorated and printed materials are used in particular for the formation of the decorative ply.

According to one preferred embodiment of the present invention, the outer ply is releasably connected to the shoulder straps. It is then possible to remove the decorative ply for expressing milk by way of a breast shield and accordingly expose the opening of the associated bra cup. The following description discusses respective further developments of the outer ply or the decorative ply, respectively, and relates to the further development of the outer ply or the decorative ply, respectively, to form a single bra cup. It is understood that this development regularly applies to both bra cups, since the required functionalities and developments should be provided for both cups in an identical manner.

Due to the releasable outer ply, the outer ply can accordingly be made to assume a defined position for expressing breast milk in which the opening is exposed. The outer ply is typically connected to the circumferential envelopment, so that the outer ply hangs down from the shoulder straps after the outer ply has been released when breast milk is expressed.

However, any other configuration is also conceivable. For example, the outer ply can have a more vertically extending connection to the bra cup or the circumferential envelopment or the shoulder straps, respectively, in order to be folded away laterally. In this case, two portions of the outer ply are connected to each other, for example, in the middle, i.e. in the region of the sternum, when the bra is worn as such, without breast milk being expressed. The outer ply can then be attached directly to the shoulder straps, i.e. reach up to the shoulder straps and be connected to the shoulder straps by way of a releasable attachment device. However, a connection to the shoulder straps can also be effected indirectly, regularly by attaching the outer ply to the circumferential envelopment and/or the bra cup. In this case, the outer ply can be connected to the bra cup and/or the circumferential envelopment by way of a flap, a push button, a clip connection, a hook-and-loop fastener or any other type of connection that is common in textile technology. It is only important that the impression of a uniform, aesthetically pleasing bra can be created by the direct or indirect attachment of the outer ply to the associated shoulder strap.

The same applies to the bra cups which are indirectly or directly attached to the shoulder straps by way of the aforementioned attachment device. According to a preferred embodiment, the respective bra cup and the associated outer ply are independently releasable directly or indirectly from the shoulder straps as well as jointly releasable therefrom. The option therefore exists to release the bra cup and the outer ply jointly from the shoulder straps, i.e. with a single hand motion, to expose the female breast for breastfeeding.

According to one preferred embodiment of the present invention, each bra cup is made of a cutting comprising at least two cup elements, where the opening providing access to the nipple is formed in the region of the joining point between the two cup elements. The joining point is preferably designed such that the material forming the bra cup covers and protects the nipple. Accordingly, the nursing bra according to the invention is preferably designed such that the nipple is covered by the inner layer, i.e. the bra cup, despite the existence of an opening, at least when the bra is worn.

The flap is in this context preferably provided integrally formed on one of the cup elements, usually cut out from the material forming the respective cup element. The flap then extends over the joining point between the two cup elements. The flap is typically located forward of the inner surface of the cup element not comprising the flap. Preferably, the flap abuts against the inner surface of this cup element. The flap is preferably formed from material that is identical to the material of the bra cup. The bra cups are preferably formed from the same material.

The flap is in this context configured and sized such that the flap can be folded away from the opening for inserting a tubular end of the breast shield in order to expose the opening when the tubular end of the breast shield is guided from the inner side through the opening to the outer side. The flap is in this context preferably elastically deformed, this preferably entailing no deformation of the bra cup. In other words, the cutting is done in such a manner that only the flap is deformed when the tubular portion of the breast shield is passed through, but the associated bra cup at least substantially maintains its shape following the contours of the breast.

The flap preferably has a mushroom-like configuration, where the region of the flap extending toward the other cup element forms a convex end surface, the apex of which can be approximated by a tangent extending substantially parallel to the phase boundary between the two cup elements. This convex end surface can at the edges of the actual mushroom head transition into a concave surface. In any case, the mushroom head is defined by converging edge sections which branch off from the end surface and converge towards one another. These edge sections typically extend parallel to the phase boundary of the two cup elements and are attached to the bra cup by way of a seam attaching the two cup elements. Since the flap also in this embodiment is preferably cut in one piece from the material forming the one cup element, "attachment" in this context means only a positional fixation of the edge sections of the bra cup above the seam.

Accordingly, the edge sections preferably terminate at a boundary surface of the two cup elements, where they are connected to one another by a seam, where the flap is indeed integrally formed on one of the cup elements and only a defined design of the flap is defined by the seam, without it there being connected to its associated cup element. However, this seam or another seam can connect the cup element comprising the flap to the cup element covered by the flap.

In this mushroom-like embodiment, a flap base connecting the flap to the associated cup element can be located between the two edge sections. The flap base is understood to be any connection between any kind of flap and the associated cup element. The flap base connects the flap that is usually attached to the material of the cup element to the material that follows the shape of the breast as part of the bra cup. With a view to a conceivable support function of the breast shield during the expressing action, it is proposed according to a preferred development of the present invention that the flap base attached to the cup element is located between the opening and the breast part. In this arrangement, the flap base is disposed below the nipple after the nursing bra has been donned and can therefore be abutted against a funnel portion of the breast shield that is circumferentially abutable against the breast shield, especially in a manner following the contour of the breast. This improves the support of the breast shield at least when being applied until sufficient suction pressure has developed when expressing breast milk with which the breast shield is abutted against the female breast under negative pressure.

According to one preferred embodiment of the present invention, the cup elements adjoin each other at an angle. This angle can vary over the length of the boundary surface of the two cup elements. The apex of the boundary surface and, accordingly, the smallest angle during wear on the inner side of the cup elements is determined by the shape of the female breast and can vary. The angle gives the two cup elements a certain shape. The cup elements are held in shape at this angle and by a seam such that the seam can be regarded as a "shaping seam". In this preferred development of the present invention, the outer ply or the decorative ply, respectively, preferably in the region of the opening comprises a decorative seam following the shaping seam. The decorative seam preferably follows the course of the shaping seam. The cuttings are preferably selected such that a kind of positive-fit connection and/or centering of the outer ply or the decorative ply, respectively, is effected due to the seam, relative to the more dimensionally stable bra cups. This results in a visually appealing appearance.

According to the above description, the present invention accordingly provides a nursing bra which is capable of supporting the breast shield and accordingly allows breast milk to be expressed without there being a need for the milk bottle, the breast shield and/or the pump to be held. Rather, expression can be effected in a "hands-free" manner. The bra cups each have an opening that can be easily closed by the flap, which additionally protects the nipple and, in particular, prevents the nipple from rubbing against edges of the opening. This results in a nursing bra that is associated with no restrictions in terms of wear comfort, even when there is the option of expressing breast milk through the opening. The external design can be chosen arbitrarily, depending on the specific design of the outer ply. It has essentially the function of completely or partially covering the bra cups as the outer layer. The decorative ply at least covers the opening, so that this region of the bra cups is decoratively concealed. A pleasant appearance can be obtained, in particular, when the decorative ply is made of lace. The nursing bra can then also be used as an everyday bra. The outer ply or the decorative ply, respectively, is preferably indirectly or directly releasable from the shoulder straps to expose the opening. However, the outer ply or the decorative ply, respectively, is preferably also releasable together with the bra cup to allow the infant to be breastfed with the breast exposed.

According to one preferred embodiment of the present invention, the shaping seam connecting the cup elements is designed as a reinforcing element. The seam material can exhibit, for example, greater stiffness than the cutting forming the cup element. Alternatively, the seam material itself can have no reinforcing supportive effect, but rather be configured several times over the joining point of the two cup elements in order to increase the rigidity of the bra cup in the region of the joining point and due to the design of the shaping seam. This embodiment offers the possibility of shaping the cutting forming the individual cup elements from a relatively soft material, while giving the bra cup increased rigidity in the region of the seam and by the seam, so that the shaping of the seam is predominantly or even exclusively determined by the seam, its design and/or the strength of the seam material selected.

BRIEF DESCRIPTION OF THE SEVERAL VIEWS OF THE DRAWING

Further details and advantages of the present invention shall become apparent from the following description of an embodiment in combination with the drawing, in which.

DETAILED DESCRIPTION OF THE PREFERRED EMBODIMENTS

Figure 1:
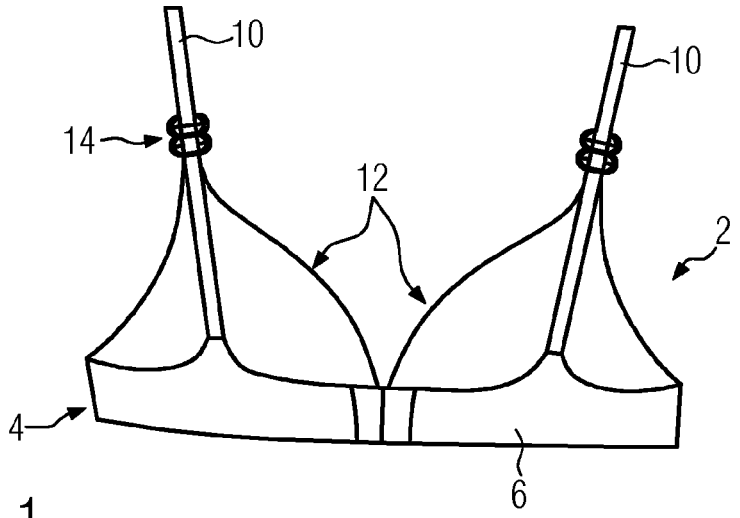
FIG. 1 shows a rear view of an embodiment of the nursing bra according to the invention.
Figure 2:
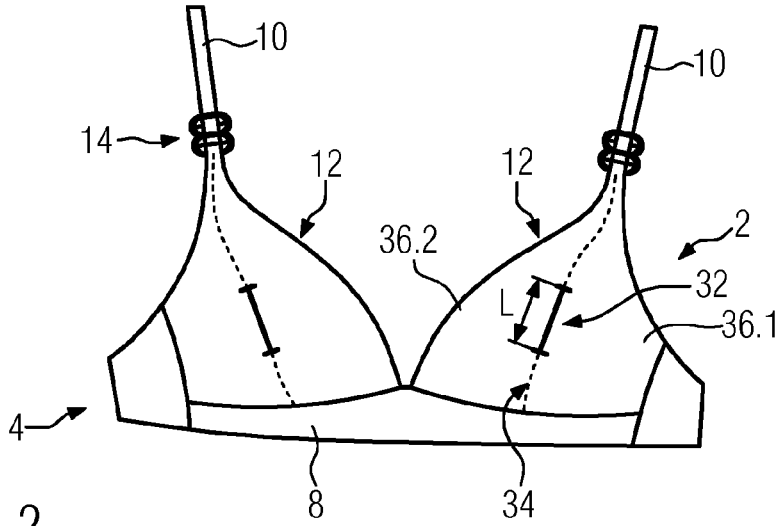
FIG. 2 shows a front view of the embodiment shown in FIG. 1 without the decorative ply.

FIGS. 1 and 2 show the basic structure of the nursing bra marked with reference numeral 2 comprising a circumferential envelopment 4 which is formed by a back part 6 and a breast part 8 connected thereto in the circumferential direction which is presently formed substantially by a lower breasts panel closely abutting against the ribs below the female breast. Shoulder straps 10 extend from the breast part 8 shown in FIG. 2 and are passed over the two shoulders of the woman and provided for vertical stabilization of bra cups 12 marked with reference number 12. The two bra cups (12) are three-dimensionally shaped and serve to accommodate the female breasts. In the embodiment shown, the back part 6 is separated in the middle and has eyelets at different distances as known per se for width adjustment of the circumferential envelopment 4, in which hooks disposed on the opposite partial section of the back part 6 can engage for circumferentially closing the back part 6 and the breast part 8. Similarly, fine adjustment of the length of the shoulder straps 10 is possible by way of adjusting devices, not shown in detail. For example, the shoulder strap 10 can respectively be passed as a loop through a hook 14 highlighted in FIG. 4 and can be fixed in a slidable manner with its free end relative to the part of the shoulder strap 10 which runs over the shoulder in order to obtain different lengths.

Figure 4:
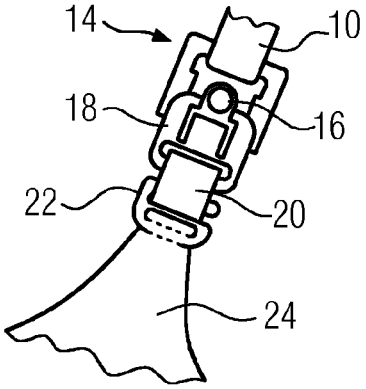
FIG. 4 shows details of the connection between a shoulder strap and a bra cup of the embodiment.

The hook 14 shown in FIG. 4 has a locking projection 16 which in the joined state projects through an opening of an eyelet designated by reference numeral 18. The eyelet 18 is connected directly to the upper end of an associated bra cup (not shown in FIG. 4) and with a band ring 20 to an open hook 22 which is connected to the upper free end of a decorative ply designated by reference numeral 24.

Figure 12:
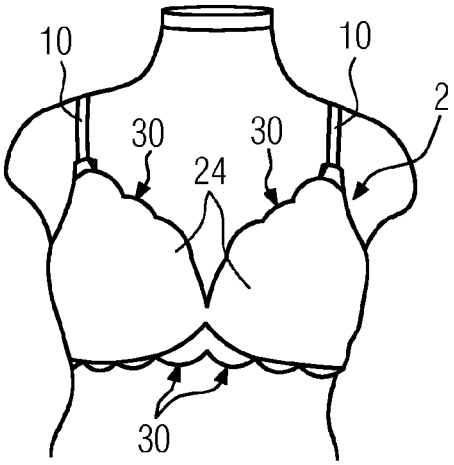
FIG. 12 shows a second embodiment of a nursing bra when used as an everyday bra.
Figure 13:
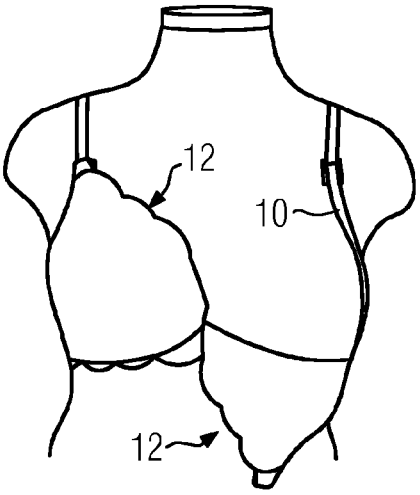
FIG. 13 shows the embodiment shown in FIG. 12 with the left breast exposed.

Due to this configuration, the bra cup 12 with the associated decorative ply 24 can be released together from the shoulder straps 10 by unhooking the eyelet 18 to expose the breast for breastfeeding a child, as is common practice with nursing bras 2. However, the present invention is not restricted to the embodiment shown. It is only important that the bra cup 12 and the associated decorative ply 24 are indirectly or directly releasably connected to the shoulder strap 10 to remove both in the typical state of use over plies disposed above the female breast jointly and together from the breast (see FIG. 12).

Figure 3:
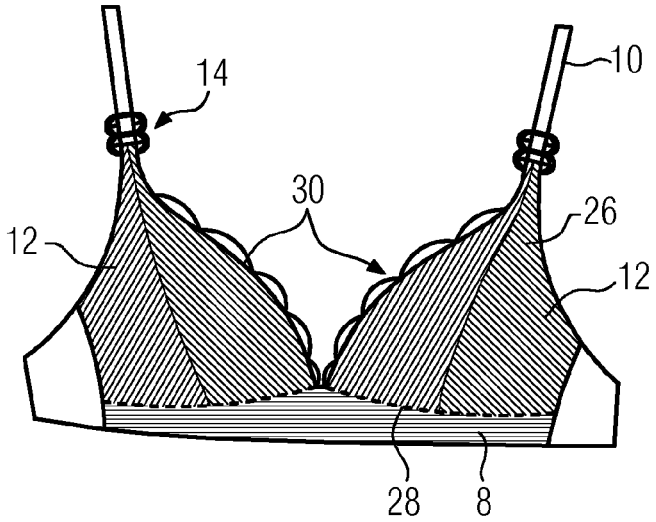
FIG. 3 shows the decorative ply applied on the front side to the bra cups of the embodiment.

FIG. 3 shows a first example of such a decorative ply 24 in the form of a substantially full-surface cladding layer 26 which is located on the outer side of the bra cup 12. The cladding layer 26 also extends over the breast part 8, so that the nursing bra 2 has a uniform design from the front. The cladding layer 26 above the bra cup 12 is optically contrasted from the breast part 8 by way of a decorative seam 28. For example, at the opposite edges of the bra cups 12, the cladding layer 26 comprises lace 30 which projects beyond the lateral edges of the bra cups 12 and conceals them.

By releasing the open hook 22 from the band ring 20, the cladding layer 26 can be removed from the associated bra cup 12 so that the outer surface of the bra cup 12 temporarily forms the outer surface of the nursing bra 2. In the region of the bra cups 12, the nursing bra 2 has a respective opening 32 which is formed as an omission of a joining seam 34, where the joining seam 34 joins two cup elements 36 marked with reference number 36 in FIG. 2.

The opening 32 is formed by omitting the joining seam 34 over a length L of between 3 cm and 6 cm. The nipple is typically centered relative to the opening 32, but can also be slightly off center upwardly or downwardly relative to the center of the opening 32. These specifications apply to any joining seam 34 regardless of its specific orientation. In the embodiment according to FIGS. 1 to 5, this joining seam 34 is formed to extend substantially vertically. But it can also be formed extending horizontally or at an angle.

Approximately two-thirds of the total length of the closed seam from the releasable hook 14 to the lower breast panel is disposed between the hook 14 and the upper edge of the opening 32. Approximately one-third of the total length of the joining seam 34 is disposed below the opening 32, i.e. between the lower edge of the opening 32 and the lower breast panel, i.e. the breast part 8.

The joining seam 34 is a shaping seam. Accordingly, the cup elements 36 abut each other at a certain angle in the joining seam 34. Due to this configuration, the opening 32 is located at the point furthest away from the costal arch, which facilitates the insertion of a breast shield for expressing breast milk. The decorative seam 28 joins cuttings of the decorative ply in shape, extension and contour like the joining seam 34, so that, when this decorative ply 24 has been applied, the bra cups 12 are covered thereby in a manner following the contour and having the same cut.

Figure 5:
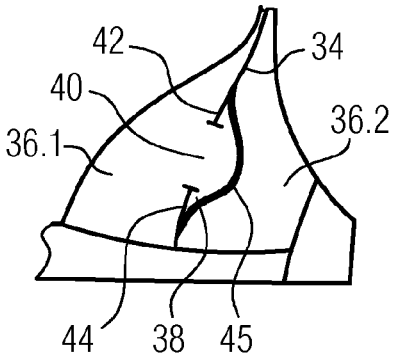
FIG. 5 shows a rear view of the bra cup of the embodiment.

FIG. 5 illustrates the configuration of the bra cup 12 on its inner side. The left cup element 36.1 comprises a flap 38 which is integrally connected by an end-to-end flap base 40 to the fabric element forming the left cup element 36.1. The flap base 40 is provided between an upper edge section 42 and a lower edge section 44 of the flap 38, where the upper and the lower edge sections 42, 44 are sewn with the joining seam 34 to the left and the right cup element 36.1, 36.2 and connected thereto. Accordingly, the opening 32 is formed between the upper and the lower edge sections 42, 44 on the oppositely disposed outer side. By folding away the flap 38 from the inner surface of the right cup element 36.2, the opening 32 can be exposed on the inner side.

The flap 38 projects beyond the left cup element 36.1 in a mushroom-like manner. The apex of the generally convex formation of an end surface 45 of the flap 38 is in extension of the flap base 40. Edge sections of the mushroom head can be curved in a convex or concave manner to approximate the upper respectively the lower edge sections 42, 44 with this curvature, respectively, which end at the boundary surface of the two cup elements 36.1 and 36.2, respectively.

The flap 38 is preferably cut such that, after the tubular section of a breast shield has been passed through, the flap 38 projecting on the inner side from the bra cup 12 partially circumferential abuts the funnel-shaped section of the breast shield and imparts a certain support function there. The flap 38 of the solution according to the invention then has two different functions. First of all, it covers the opening 32 so that the nipple does not rub against the edges of the opening. The nipple is instead accommodated in a continuous and steplessly lined interior of the bra cup 12. When breast milk is expressed through the breast shield, the flap 38 provides a certain support function at least until the funnel-shaped portion of the breast shield has been sucked onto the surface of the breast due to the action of the suction pressure and situational positioning has then taken place.

Figure 6:
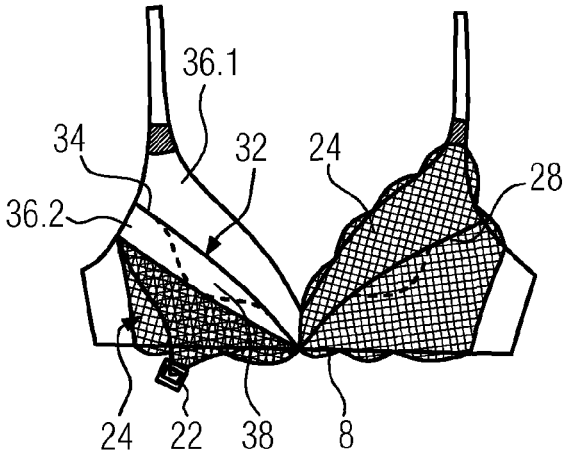
FIG. 6 shows a first embodiment of a lady's chemise.

FIG. 6 shows an alternative embodiment in which the decorative ply 24 is partially sewn fixedly onto the outer surface of the bra cup 12. The seam (28 and 34, respectively) extends obliquely upwardly from the center of the breast part 8 in the direction towards the outer circumferential edge of the bra cup 12 which is located above the circumferential envelopment 4. On the right-hand side, FIG. 6 shows the coverage of the bra cup 12 by the decorative ply 24 and the decorative ply 24 for the left bra cup 12 removed from the bra cup 12 for exposing the opening 32. The shaping joining seam 34 there likewise extends obliquely upwardly, however, steeper than the seam of the decorative ply. The flap 38 is indicated by a dash-dotted line. As illustrated by the right-hand part of FIG. 6, the joining seam 34 there also extends strictly parallel to the decorative seam 28.

Figure 7:
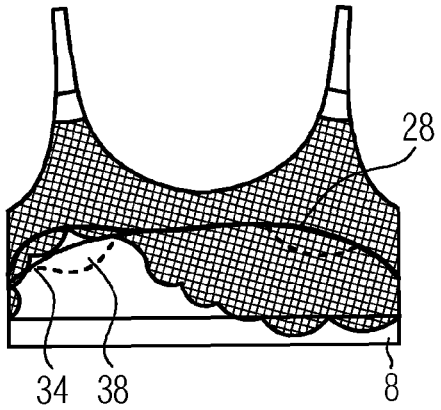
FIG. 7 shows an embodiment of a second cutting.

A corresponding picture arises for FIG. 7, which illustrates another embodiment. A uniform joining seam 34 is provided there for both bra cups 12 and extends approximately horizontally. The flap 38, which is indicated by a dash-dotted line for this front view, is disposed below the joining seam 34 and therefore between the breast part 8 and the joining seam 34. The decorative ply 24 is fixedly connected, in particular, sewn with its upper edge to the bra cups 12 and be raised for exposing the opening 32, as indicated in FIG. 7 on the left-hand side. The decorative ply 24 can be connected by way of hook-and-loop fasteners or the like to the breast part 8, in order to abut against the outer surface of the actual bra cup 12 in a manner following the contour as much as possible. The decorative ply 24 can also be suspended freely from the upper region of the bra cups 12.

Figure 8:
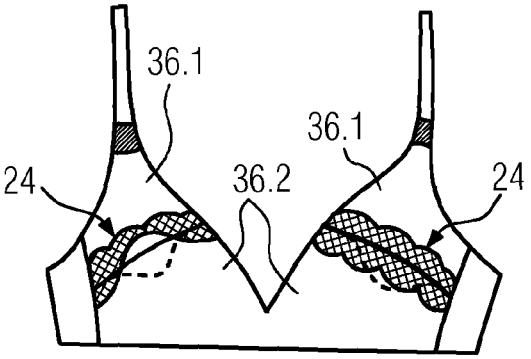
FIG. 8 shows an embodiment of a third cutting.

FIG. 8 shows an alternative embodiment in which the decorative ply 24 is arranged as a narrow decorative strip 46 only over a certain height region of the joining seam 34 and covers the latter. Since each decorative strip 46 is not connected over the entire surface to the outer surface of the bra cup 12, the opening 32 can be exposed by raising the decorative strip 46.

Figure 9:
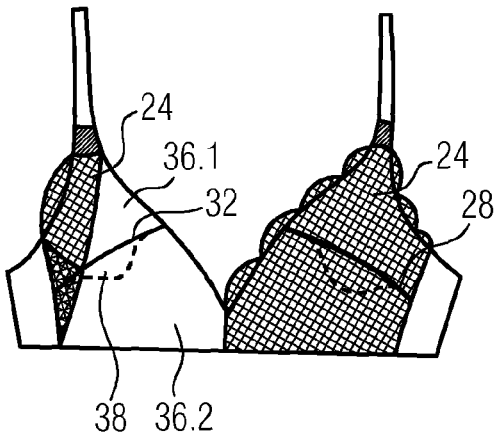
FIG. 9 shows an embodiment of a fourth cutting.

FIG. 9 illustrates another embodiment in which the joining seam 34 extends approximately in correspondence to FIG. 8. The joining seam 34 provided for every bra cup 12 extends obliquely upwardly to the middle of the breast. The decorative ply 28 covers the bra cups 12 on the outside basically over the entire surface. Toward the outer edge, it can be fixed against the bra cups 12 or the circumferential envelopment 4, respectively, for example, by way of a hook-and-loop fastener, and can expose the opening 32 by being raised and pivoted inwardly.

Figure 10:
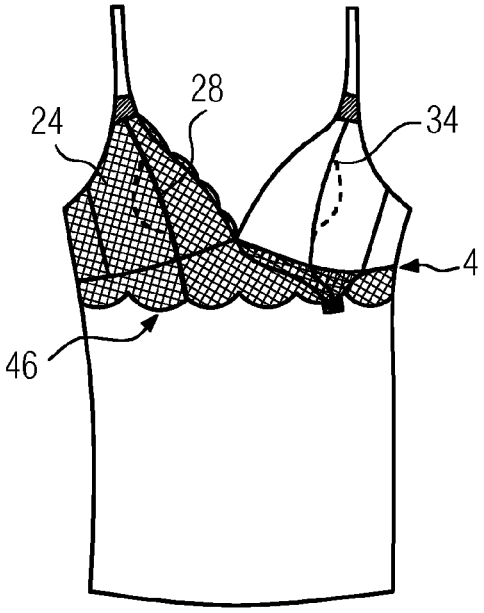
FIG. 10 shows an embodiment of a fifth cutting.
Figure 11:
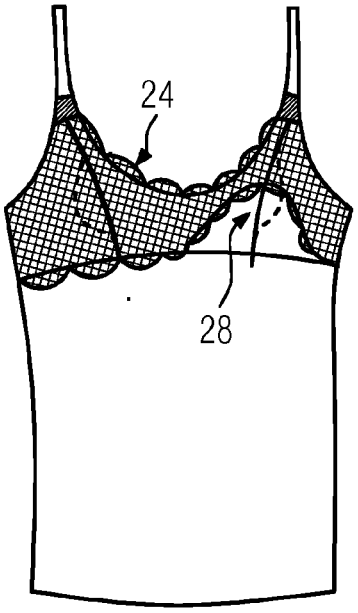
FIG. 11 shows an embodiment of a sixth cutting.

In the embodiment shown in FIG. 10, the decorative seam 28 is longer than the joining seam 34. But here as well, both seams 28, 34 extend parallel to each other, and—like in the first embodiment according to FIGS. 1 to 5—in a substantially vertically manner. The embodiment according to FIG. 10, as well as that according to FIG. 11, is designed as a lady's chemise, so that the nursing bra 2 is formed as part of a textile that substantially covers the predominant upper body. The decorative ply 24 can project arbitrarily far downwardly, possibly completely cover the front side of the lady's chemise, possibly also the back. In the embodiment of FIG. 10, the decorative ply 24 terminates slightly below the bra cups 12 as substantially horizontally extending decorative strip 46. Like in the first embodiment, the decorative ply 24 is connectable via the eyelet 18 to the shoulder strap 10 and releasable therefrom. The lower end of the decorative ply 24 is in the region of the circumferential envelopment 4 firmly connected to the bra part of the lady's chemise, as shown on the right-hand side of FIG. 10.

Unlike the embodiment of FIG. 11 in which the decorative ply 24 is fixedly connected at its upper end to the shoulder straps 10 and can be raised to expose the opening 32.

REFERENCE NUMERALS

2 nursing bra
4 circumferential envelopment
6 back part
8 breast part
10 shoulder strap
12 bra cups
14 hook
16 locking device
18 eyelet
20 band ring
22 open hook
24 decorative ply
26 cladding layer
28 decorative seam
30 lace
32 opening
34 joining seam
36 cup element
38 flap
40 flap base
42 upper edge section
44 lower edge section
45 end surface
46 decorative strip

The invention claimed is:

1. A nursing bra with a back part and a breast part, which form a circumferential enclosure in a connected state, with shoulder straps extending between said breast part and said back part and with two bra cups, each adapted to accommodate a female breast and each releasably connected to said shoulder straps and each having an opening that leads to a nipple of said female breast and that is on an outer side covered by an outer ply which is removable from said opening, a flap provided on an inner side of said bra cup covers said opening, each of the bra cups being formed from a cutting comprising at least two cup elements, the opening being formed in a region of a joint between said two cup elements, the flap being provided in an integrally formed manner on one of the cup elements, and the flap having a mushroom-like shape, including an at least partially convex-shaped end surface with ends, edge sections branching off the ends of the at least partially convex-shaped end surface, the edge sections converging towards one another.

2. The nursing bra according to claim 1, the outer ply being releasably connected to the shoulder straps.

3. The nursing bra according to claim 1, the bra cups and the outer ply being releasable independently of each other and jointly from said shoulder straps.

4. The nursing bra according to claim 1, the outer ply being formed as a decorative ply.

5. The nursing bra according to claim 4, the decorative ply covering the bra cups over an entire surface of the bra cups.

6. The nursing bra according to claim 1, the edge sections terminating at a boundary surface of the two cup elements.

7. The nursing bra according to claim 1, a flap base connected to said cup element arranged between the opening and the breast part.

8. The nursing bra according to claim 1, the cup elements abutting one another at an angle and connected by a shaping seam and that the outer ply at least in a region of the opening comprising a decorative seam following said shaping seam.

9. The nursing bra according to claim 4 the decorative ply and outer surfaces of the circumferential enclosure are formed to be at least one of a uniform colored, material, or textural design.

10. The nursing bra according to claim 8, the shaping seam being formed as an element reinforcing the cup elements.

* * * * *